United States Patent [19]

Strange

[11] Patent Number: 4,782,903

[45] Date of Patent: Nov. 8, 1988

[54] REPLACEABLE INSERT STUD FOR DRILLING BITS

[76] Inventor: William S. Strange, Rte. 3, Box 489, Marshall, Tex. 75670

[21] Appl. No.: 112,259

[22] Filed: Oct. 22, 1987

Related U.S. Application Data

[63] Continuation-in-part of Ser. No. 7,498, Jan. 28, 1987, abandoned.

[51] Int. Cl.[4] ..... E21B 10/62; E21B 10/46

[52] U.S. Cl. ..... 175/410; 175/329; 175/413

[58] Field of Search ..... 175/329, 330, 410, 412, 175/413

[56] References Cited

U.S. PATENT DOCUMENTS

| | | | |
|---|---|---|---|
| 63,681 | 4/1867 | White | 175/413 X |
| 439,972 | 11/1890 | Muirhead | 175/413 X |
| 875,664 | 12/1907 | Karns | 175/413 |
| 884,150 | 4/1908 | Hardsocg | 175/410 X |
| 972,666 | 11/1910 | Weston | 175/413 |
| 1,077,772 | 11/1913 | Weathersby | 175/413 |
| 1,862,814 | 6/1932 | Wright et al. | 175/413 |
| 2,244,537 | 6/1941 | Kammerer | 175/412 |
| 2,545,195 | 3/1951 | Crake | 175/330 |
| 2,710,180 | 6/1955 | Graham | 175/413 |
| 3,035,647 | 5/1962 | Pickard et al. | 175/330 |
| 4,098,362 | 7/1978 | Bonnice | 175/329 |
| 4,323,130 | 4/1982 | Dennis | 175/329 |
| 4,337,980 | 6/1982 | Krekeler | 175/413 X |
| 4,511,006 | 4/1985 | Grainger | 175/329 X |
| 4,538,690 | 9/1985 | Short, Jr. | 175/329 |
| 4,655,508 | 4/1987 | Tomlinson | 175/413 X |

FOREIGN PATENT DOCUMENTS

| | | | |
|---|---|---|---|
| 469703 | 9/1970 | Australia | 175/329 |
| 10752 | of 1845 | United Kingdom | 175/413 |
| 2275 | of 1854 | United Kingdom | 175/413 |

*Primary Examiner*—Hoang C. Dang

*Attorney, Agent, or Firm*—Daniel V. Thompson

[57] ABSTRACT

Threaded insert studs are disclosed for insertion into a drilling bit body. Holes are predrilled or precast into the bit body, and the studs are inserted in the holes. Locking nuts are used to secure the studs in place. The insert studs and holes are tapered to allow a close interfitting relationship between the insert studs and holes, and an elongated key is engaged with aligned, longitudinal slots in the insert studs and holes.

1 Claim, 2 Drawing Sheets

FIG. 1
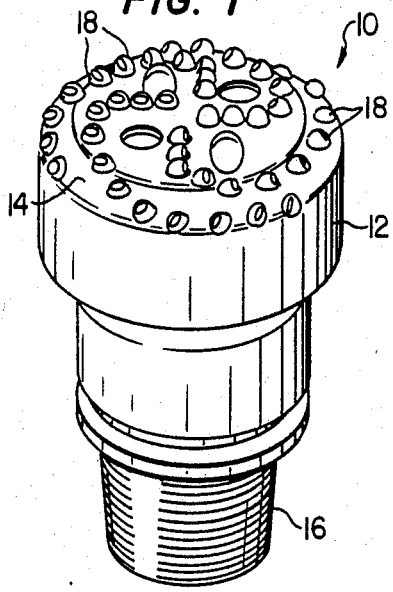
FIG. 2
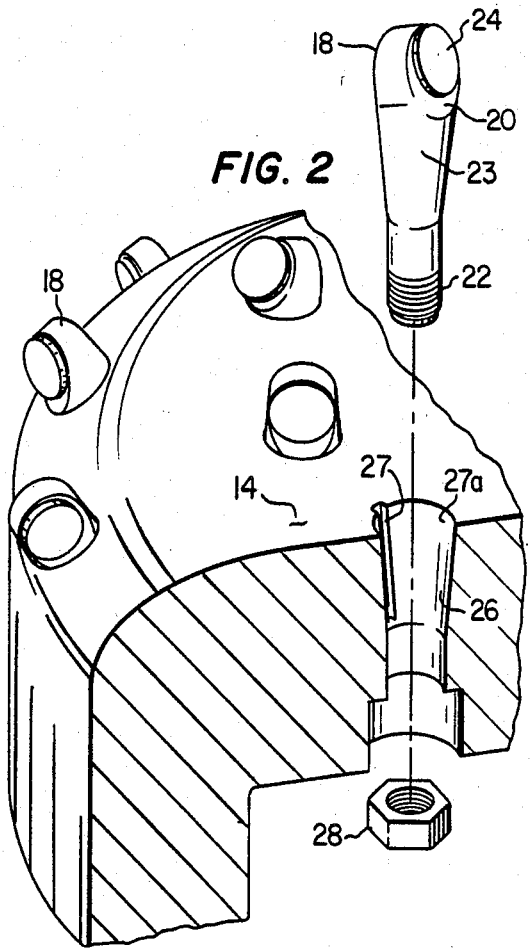
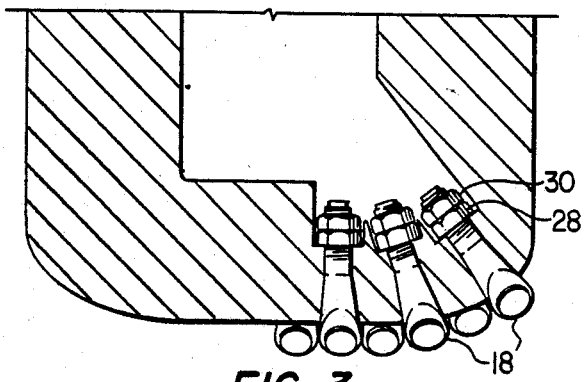
FIG. 3
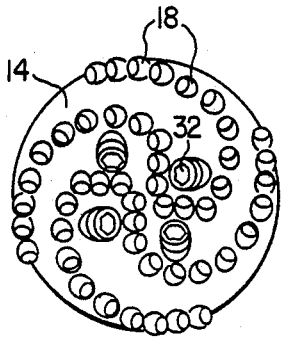
FIG. 4

FIG. 5
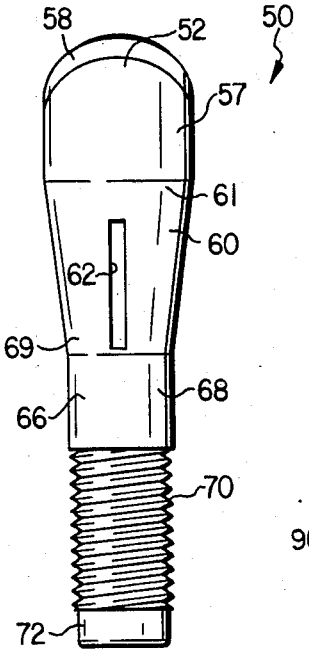
FIG. 6
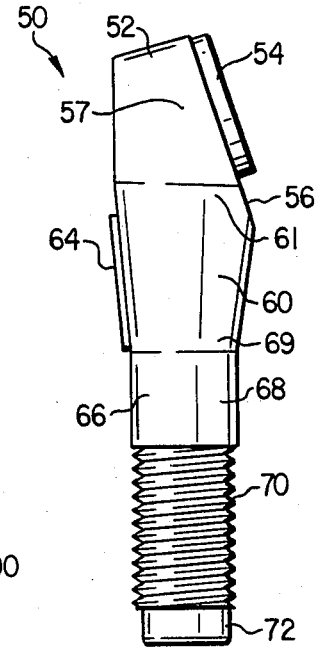
FIG. 7
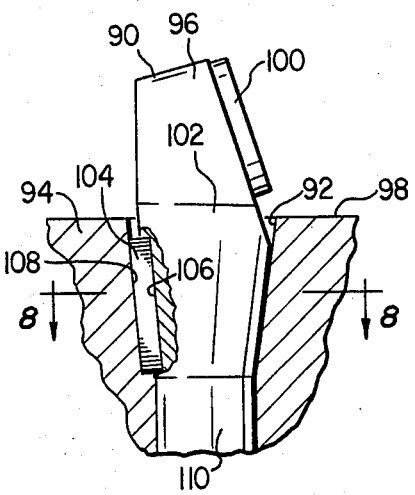
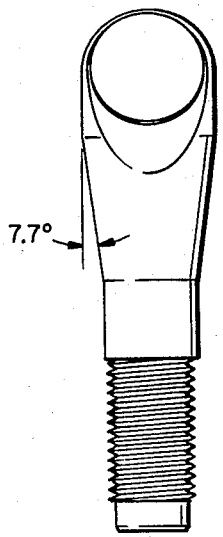
FIG. 9A
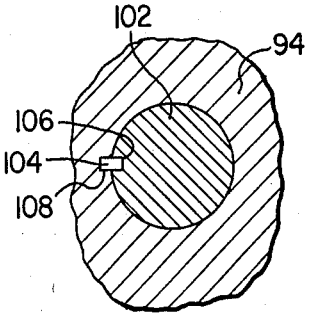
FIG. 8
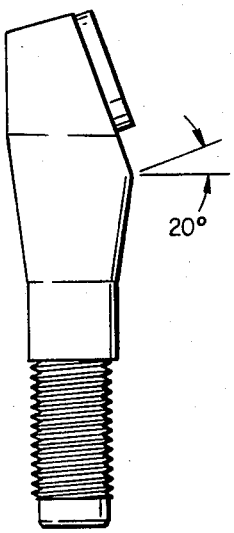
FIG. 9B

REPLACEABLE INSERT STUD FOR DRILLING BITS

CROSS REFERENCE

This is a continuation-in-part of application Ser. No. 007,498, filed Jan. 28, 1987, now abandoned.

TECHNICAL FIELD

This invention relates to insert studs for drilling bits, and more particularly to a replaceable insert stud for drilling bits.

BACKGROUND OF THE INVENTION

Insert studs for drilling bits are typically brazed or interference fitted. These bits must be returned to the manufacturer's shop to have any or all studs that are broken replaced. High shipping costs from remote drilling sites, a three-week to three-month waiting time for repairs, and a repair charge in addition to a charge for replaced studs make these options undesirable. These methods may also allow a stud to work itself free and thus, reduce the efficiency of the bit. Additionally, interference fitting can result in damage to the expensive insert stud and any diamond coating it may have.

One attempt to prevent any damage to the insert stud is shown in U.S. Pat. No. 4,325,439 to Vezirian, Apr. 20, 1982. This patent discloses a special insert shape and an installation tool designed to fit over the insert. This certainly minimizes damage to the insert but has no affect on the problem of the bit working free during use.

Thus, there is a need for a way to install an insert stud without damage and that will prevent it from working itself free. Also there is need for a way to cut cost and lost time by having a field replaceable insert stud.

SUMMARY OF THE INVENTION

A replaceable insert stud for drilling bits is provided. Replaceability of the stud is provided by threads on the end opposite the cutter face. The bit is predrilled or precast to receive the insert. After the insert is positioned a locking nut is used to secure it to the bit.

The insert stud is a generally elongated, solid body having a first cutter end joined to a second threaded end by way of a tapered middle section. The first cutter end can be one of several different shapes and angles and may be provided with a diamond or polycrystalline diamond coating. The second threaded end is provided with sufficient threading to secure it to the bit. A key is fitted to grooves in the stud and the hole to prevent rotation of the stud after installation.

BRIEF DESCRIPTION OF THE DRAWINGS

For a more complete understanding of the present invention and for further advantages, thereof, reference is now made to the following Detailed Description of the Preferred Embodiment taken in conjunction with the accompanying Drawings, in which:

FIG. 1 is a perspective view of a drilling bit with insert studs in position;

FIG. 2 is a partial exploded view showing one insert stud as per the present invention;

FIG. 3 is a partially broken-away side view showing several insert studs of the present invention as they would be installed;

FIG. 4 is an end view of the working end of the drilling bit showing a typical pattern for the insert studs;

FIG. 5 is a back view of an insert stud;

FIG. 6 is a side view of an insert stud;

FIG. 7 is a partially broken-away side view of an installed insert stud;

FIG. 8 is a sectional view taken along lines 8—8 of FIG. 7; and

FIGS. 9A and 9B are front and side views of the insert stud of the present invention showing the dimensions of the preferred embodiment of the insert stud.

DETAILED DESCRIPTION OF THE PREFERRED EMBODIMENT

Referring to FIG. 1, a drilling bit of the present invention is generally identified by the reference numeral 10. The bit consists of a bit body 12, a working end 14, and an inlet end 16. Insert studs 18 are shown to protrude from working end 14. Insert studs 18 may be fabricated, for example, from a tungsten carbide substrate. Alternatively, a carbide-coated steel alloy body may be used to fabricate the insert studs 18.

FIG. 2 shows insert stud 18 as it would be placed in the working end 14 of the drilling bit 10. Insert stud 18 has a first cutter end 20 and a second threaded end 22 joined by a tapered middle portion 23. The first cutter end 20 can have a coating 24 such as diamond or polycrystalline diamond.

A plurality of predrilled or precast tapered holes 26 are strategically placed in working end 14. A groove 27 is formed longitudinally in the inner wall 27*a* of each tapered hole 26 to accept a key (not shown) in the back of insert stud 18. Insert stud 18 is secured in hole 26 by lock nut 28.

FIG. 3 shows a series of insert studs 18 installed in working end 14. Insert studs 18 are secured by lock nuts 28 and an additional optional lock nut 30.

FIG. 4 shows one of many possible strategic patterns for placing insert studs 18 in working end 14. Nozzles 32 are provided to direct drilling fluid in conventional fashion.

Referring now to FIGS. 5 and 6, the insert stud 50 of the preferred embodiment includes a body 52 and a polycrystalline diamond cutter element 54. Element 54 is secured in conventional fashion to planar face 56 of body 52. The first end 57 of stud 50 is partially cylindrical about the sides and back, being intersected by the angled plane of planar face 56. In the preferred embodiment, planar face 56 is angled from the longitudinal axis of body 52 by approximately 20 degrees. A rounded upper surface 58 is provided at the top of first end 57. A tapered middle portion 60 is formed adjacent first end 57. Middle portion 60 is frustoconical in shape, being partially intersected by the lower portion of planar face 56, as shown in FIG. 6, and joined at its large end 61 to first end 57. Middle portion 60 includes a longitudinal slot 62 formed in the back thereof to snugly accept a rectangular key 64, as shown in FIG. 6. Second end 66 of cutter 50 includes an upper cylindrical portion 68 joined to the small end 69 of middle portion 60 and a threaded portion 70. A smaller diameter end portion 72 is joined to threaded portion 70. In the preferred embodiment, middle portion 60 is tapered from the longitudnal axis of body 52 by approximately 7.7 degrees, as shown in FIG. 9.

Referring now to FIGS. 7 and 8, an insert stud 90 of the present invention is shown installed in a tapered hole 92 in working end 94 of a drill bit. First end 96 of stud 90 extends above the surface 98 of cutting end 94, thereby exposing diamond 100. Tapered middle portion 102 is engaged with tapered hole 92. The tapers of middle portion 102 and threaded hole 92 are substantially equal to enable a close-fitting relationship. Rectangular key 104 is engaged with the aligned longitudinal groove 106 in middle portion 102 and longitudinal groove 108 in threaded hole 92. Grooves 106 and 108 closely engage key 104 to prevent rotation of stud 90 once it is secured to cutting end 94 of the drill bit. Cylindrical portion 110 connects tapered middle portion 102 to the threaded portion of the insert stud 90, which is not shown.

Referring now to FIGS. 9A and 9B, the dimensions of the preferred embodiment of an insert stud for use with the present invention may be understood.

Although the present invention has been described with respect to a specific preferred embodiment thereof, various changes and modifications may be suggested to one skilled in the art and it is intended that the present invention encompass such changes and modifications as fall within the scope of the appended claims.

I claim:

1. A drilling bit comprising:

a bit body having a central axis, a working end and an inlet end;

said bit body having being a unitary structure with side walls extending from an end wall to form a deep cavity;

a plurality of closely-grouped holes disposed in said working end extending through the end wall in a non-interfering fashion;

a plurality of substantially identical insert studs being generally elongated along central axes thereof and having first and second ends;

said first ends being cutter ends;

said second ends being adapted for insertion into said holes in said working end of said bit body;

said second ends having threads;

said insert studs engaged with said holes such that said second threaded ends extend into said cavity in said inlet end;

a plurality of locking nuts engaged with said second threaded ends to secure said insert studs in said holes;

said first and second ends being joined by tapered frustoconical middle portions, and said holes being tapered to closely interfit with said middle portions;

longitudinal slots formed in the middle portions of the insert studs, longitudinal slots formed in the holes, said longitudinal slots in said middle portions being substantially equal in width to said longitudinal slots in said holes, said longitudinal slots in said middle portions being aligned with said longitudinal slots in said holes, and elongated rectangular keys engaged with said aligned longitudinal slots to prevent rotation of said insert studs in said holes; and said central axes of said insert studs near the outer portion of said working end being inclined relative to said central axis of said bit body and said central axes of said insert studs near the inner portion of said working end being parallel to said central axis of said bit body.

* * * * *